United States Patent [19]

Finegold

[11] Patent Number: 4,533,911

[45] Date of Patent: Aug. 6, 1985

[54] VIDEO DISPLAY SYSTEM FOR DISPLAYING SYMBOL-FRAGMENTS IN DIFFERENT ORIENTATIONS

[75] Inventor: Aryeh Finegold, Santa Clara, Calif.

[73] Assignee: Daisy Systems Corporation, Mountain View, Calif.

[21] Appl. No.: 351,647

[22] Filed: Feb. 24, 1982

[51] Int. Cl.[3] ..... G09G 1/16

[52] U.S. Cl. ..... 340/727; 340/723; 340/735; 340/750; 340/801

[58] Field of Search ..... 340/727, 728, 735, 734, 340/750, 800, 801, 723

[56] References Cited

U.S. PATENT DOCUMENTS

| | | | |
|---|---|---|---|
| 3,821,730 | 6/1974 | Carey et al. | 340/750 |
| 3,976,982 | 8/1976 | Eiselen | 340/727 |
| 4,242,678 | 12/1980 | Somerville | 340/728 |
| 4,271,476 | 6/1981 | Lotspeich | 340/727 |
| 4,283,723 | 8/1981 | Bickley et al. | 340/735 |
| 4,291,305 | 9/1981 | Kimura et al. | 340/734 |
| 4,314,357 | 2/1982 | Kimura et al. | 340/735 |
| 4,392,130 | 7/1983 | Lundström et al. | 340/728 |
| 4,486,745 | 12/1984 | Konno | 340/734 |

*Primary Examiner*—Marshall M. Curtis

*Attorney, Agent, or Firm*—Blakely, Sokoloff, Taylor & Zafman

[57] ABSTRACT

A display system particularly useful in a computer aided design system. Symbols are formed for the display from a plurality of symbol-fragments stored in memory. By simple code changes, the computer can rotate symbols without, for example, a point-by-point movement of data in memory.

11 Claims, 13 Drawing Figures

VIDEO
CONTROL
FILTER

Fig. 6a
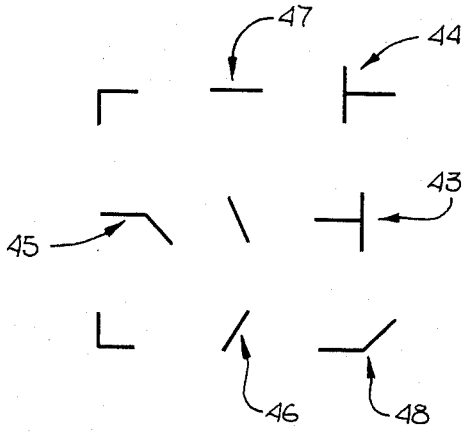
Fig. 6b
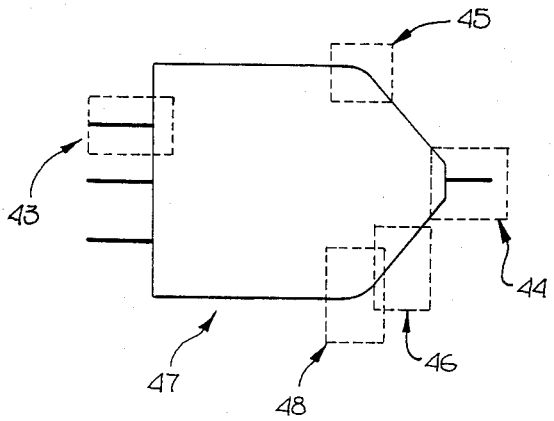
Fig. 7a
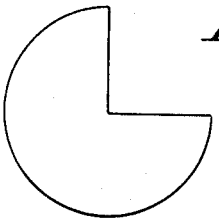
L/R BIT 11 = 1
U/D BIT 12 = 1
Fig. 7b
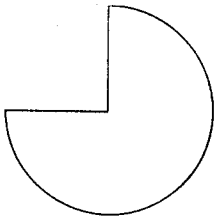
BIT 11 = 0
BIT 12 = 1
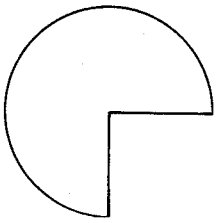
Fig. 7c
BIT 11 = 1
BIT 12 = 0
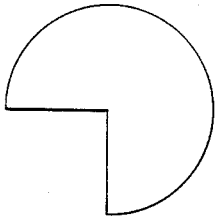
BIT 11 = 0
BIT 12 = 0
Fig. 7d
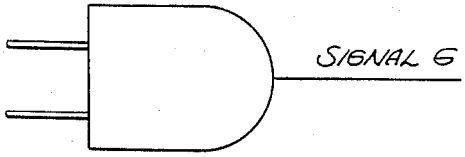
Fig. 8a
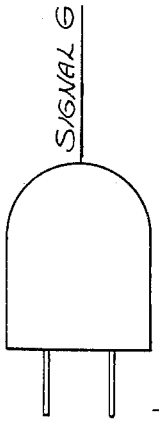
Fig. 8b

VIDEO DISPLAY SYSTEM FOR DISPLAYING SYMBOL-FRAGMENTS IN DIFFERENT ORIENTATIONS

BACKGROUND OF THE INVENTION

1. Field of the Invention

The invention relates to the field of video displays particularly raster scanned, cathode ray tube displays.

2. Prior Art

In recent years, computer-aided designs (CAD) have become widely used in many fields. Architects, engineers, scientists and others rely on computers, not only for routine computations but for more sophisticated purposes such as for prediction and simulation.

Often a visual display cathode ray tube (CRT) forms an integral part of a CAD system since visual depictions are indispensable for most designing. Complex structures can be moved, rotated, expanded and color coded on some displays providing perceptions otherwise unobtainable. In some fields, it is impossible to produce competitive products without a CAD. This is particularly true in the semiconductor industry.

A considerable amount of computer time is required to provide the displays in computer-aided design systems. By way of example, what appears to be the simple rotation of a symbol on a screen requires the movement of substantial amounts of data in memory. Other visual display effects such as highlighting of symbols, etc., while simply perceived, require substantial manipulations and consequently burden the computer.

As will be seen, the present invention provides a display system which readily facilitates the display of symbols and their rotation in addition to other display techniques.

SUMMARY OF THE INVENTION

An improvement in a raster scanned display system is described. A memory is used for storing a plurality of symbol-fragments. The symbol-fragments are each represented in memory by a predetermined number of lines and each line by a predetermined number of bits. A first circuit means is used for providing each line of each symbol-fragment in either a first order or in a reversed order. A second circuit means is used for selectively providing each bit of each line in a first order or in a reversed order. The symbol-fragments are selected from memory and used to form symbols for display. The first and second circuit means allow the symbols to be rotated (i.e., displayed in four different orientations) with a minimum of computer time. The described system provides other visual effects, namely blinking and video reversal (interchange of black and white or other colors).

BRIEF DESCRIPTION OF THE DRAWINGS

FIG. 6*a* shows examples of symbol-fragments stored in memory.

FIG. 6*b* illustrates a gate constructed from the symbol-fragments of FIG. 6*a*.

FIG. 7*a* illustrates a symbol;

FIG. 7*b* illustrates the symbol of FIG. 7*a* after a first rotation;

FIG. 7*c* illustrates the symbol of FIG. 7*a* after a second rotation; and, FIG. 7*d* illustrates the symbol of FIG. 7*a* after a third rotation.

FIG. 8*a* illustrates a gate;

FIG. 8*b* illustrates the gate of FIG. 8*a* after a rotation of 90 degrees.

DETAILED DESCRIPTION OF THE INVENTION

An improved system for displaying symbols and the like on a raster scanned display is described. In the following description, numerous specific details are set forth such as specific number of pixels, etc. in order to provide a thorough understanding of the present invention. It will be obvious to one skilled in the art, however, that the present invention may be practiced without these specific details. In other instances, well-known circuits and structures are not described in detail in order not to obscure the present invention in unnecessary detail.

The following description is particularly directed towards the display of electrical logic symbols such as gates since the presently preferred embodiment of the invention is used as part of a CAD system for electronics. The described structure may be used for displaying other symbols in other fields.

As presently implemented, the video display comprises an ordinary raster scanned, cathode ray tube. The display is used in two general modes, the first to display symbols and text, and the second to display text-only. The screen can be split and a portion of the screen used for symbols and text and the remaining portion for text-only. For displaying symbols and text, the screen is treated as a plurality of blocks, 142 in the horizontal direction and 118 in the vertical direction (hereinafter sometimes referred to as character blocks.) Each block is 7 pixels$\times$7 pixels. For the text only mode, each block is 9 pixels vertically and 15 pixels wide. There are 826 interlaced lines. Information is displayed at a rate of 1 dot or pixel each approximately 30 nanoseconds.

Figures 1, 2:
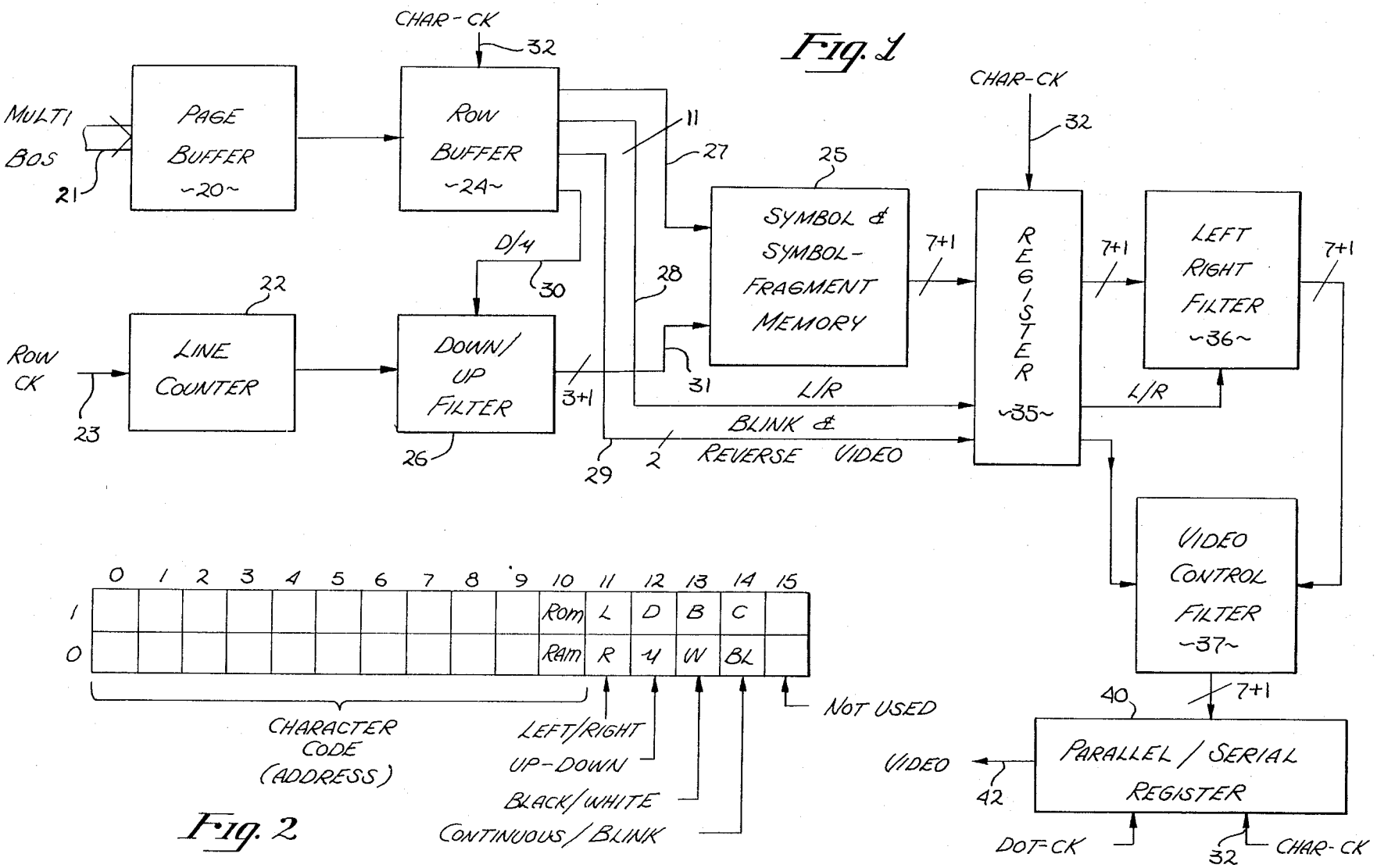
FIG. 1 is a block diagram illustrating the presently preferred embodiment of the present invention.
FIG. 2 is a chart-like diagram illustrating the binary coding used in the presently preferred embodiment.

The random-access memory of 25 of FIG. 1 is used to store a full font of alphanumeric characters for the text only mode. Also, and more importantly for the present invention, the memory 25 stores a plurality of parts of symbols which, when combined, form entire symbols. These portions of symbols are hereinafter referred to as symbol-fragments. Each symbol-fragment comprises 7 lines with each line containing 7 bits. The memory 25 also stores a set of alphanumeric characters for the symbol and text mode where each alphanumeric character is represented by 7 lines and each line by 7 bits.

Briefly referring to FIGS. 6*a*, several of the symbol-fragments stored in memory are illustrated. These fragments include corner members, straight lines, T-shaped members and others. The number and shape of these symbol-fragments is not particularly significant, and in general is determined by the symbols which are to be displayed. The several fragments shown in FIG. 6*a* have been selected since, when they are combined, they can be used to form the AND gate of FIG. 6*b*. Three of the fragments 43 are used to form the input leads and one end of the AND gate, while the fragment 44 forms the output lead. Fragment 45 forms one of the transition sections from a horizontal line to a sloped line and fragment 48 forms the complementary piece. A plurality of the horizontal line segments 47 form the horizontal portions of the gate. A plurality of the sloped lines 46 form one of the sloped portions of the gate.

As is apparent, the symbol-fragments of FIG. 6*a* and numerous others may be used to form electrical logic symbols such as AND gates, NOR gates, OR gates, etc., as well as other symbols required for other fields.

In the presently preferred embodiment, the memory 25 consists of two memories, one of which stores 1k bytes in a read-only memory (ROM) and the other 1k bytes in a random-access memory (RAM). Permanent fonts and permanent symbol-fragments are stored in the ROM. The RAM can be programmed by the user with special fonts and symbol-fragments, and, of course the RAM can be easily reprogrammed by the user with different fonts and symbol-fragments.

As currently implemented, a page buffer 20 (FIG. 1) is utilized to store sufficient data for an entire frame. The buffer 20 thus contains the addresses for each of the symbol-fragments and symbols (including alphanumeric symbols) which are to be displayed in each of the character blocks of the screen. In the presently preferred embodiment, the buffer 20 communicates through a Multibus 21 with a computer (8086). Since the buffer 20 contains sufficient information for entire frames, the computer is not required to continuously update the buffer 20. Rather, the computer updates the buffer generally when it is not performing other functions of higher priority.

The page buffer 20 communicates with a row buffer 24. The row buffer 24 in the presently preferred embodiment, comprises two 142 bit × 16 bit shift registers. Each shift register contains sufficient information to access symbols for an entire row (i.e., 142 character blocks). One of the shift registers is loaded from the page buffer 20 while the information in the other registers is used. This lessens the timing problems and allows the shift registers to operate at a relatively slow rate.

Each of the character blocks is represented by 16 bits within the row buffer 24. The chart of FIG. 2 illustrates the use of the 16 bits. The first 10 bits (0–9) are addresses for either the 1k RAM or 1k ROM. Bit 10 is used to select either the ROM or the RAM. Thus, 11 bits are used to access a particular symbol or symbol-fragment within the memory 25. These bits are communicated via line 27 to the memory 25.

Bit 11 is used to control the left/right filter 36. As will be described, this filter causes a rotation of a symbol or symbol-fragment. Consequently, changing a single bit will rotate a symbol. This bit is communicated to the left/right filter 36 via line 28, after the bit passes through the register 35.

Bit 12 controls the down/up filter 26. This filter determines whether a particular symbol or symbol-fragment is to be accessed with its first line first or its last line first. As will be seen, this filter also provides a rotation of a symbol or symbol-fragment. This bit is communicated to the down/up filter 26 via line 30.

Bits 13 and 14 are coupled to the video control filter 37 via line 29; these bits are also delayed through the register 35. Bit 13 determines whether the display will be, for example, black on white or white on black. Bit 14 controls blinking, that is, whether or not a particular character or symbol is going to be displayed continuously and whether it will be intermittently displayed (blinking).

The 16th bit (bit 15) is not used in the presently preferred embodiment.

As mentioned, the 11 bits on line 27 select a particular symbol or symbol-fragment in the memory. The bits on line 31 form part of the address for the memory 25 and select each line within each of the symbols or symbol-fragments. When symbols and text are being displayed, three bits are required from the filter 26 to access the 7 lines; during the text-only mode, 4 bits are required. A line counter 22 which is re-set by the row clock (line 23) controls the selection of each of the lines. The down/up filter will be described in more detail in conjunction with FIG. 3.

The output of the memory 25 (7 bits for the symbol and text mode and 8 bits for the text-only mode) is coupled to the register 35. After a delay within register 35 equal to one character block clock (7 pixels) this data is passed through the filter 36 and filter 37 to the shift register 40. The 7 bits or 8 bits are coupled in a parallel manner to the register 40 and then shifted serially to provide a video signal on line 42 in a well-known manner. The data from the filter 37 is loaded into the register 40 in synchronous with the character clock (line 32) and the serial shifting is controlled by the dot clock.

The information read from the row buffer 24 is held at an output latch, internal to the row buffer (20), for a time equal to the period of the character clock (approximately 215 nanoseconds). A equal delay is also caused by the register 35. These two delays provide "pipelining". The delays provide sufficient time for the memory 25 to be accessed and for the filters 26, 36 and 37 to operate on signals. The video signal shifted out on line 42 is thus 2 character clock counts in front of the symbol or symbol-fragment represented by the address in the buffer 24. Bits 11, 13 and 14 are delayed through register 35 so that the left/right signal controlling the filter 36 and the 2 bits controlling filter 37 correspond to the symbol or symbol-fragment being operated on in these filters.

Figure 3:
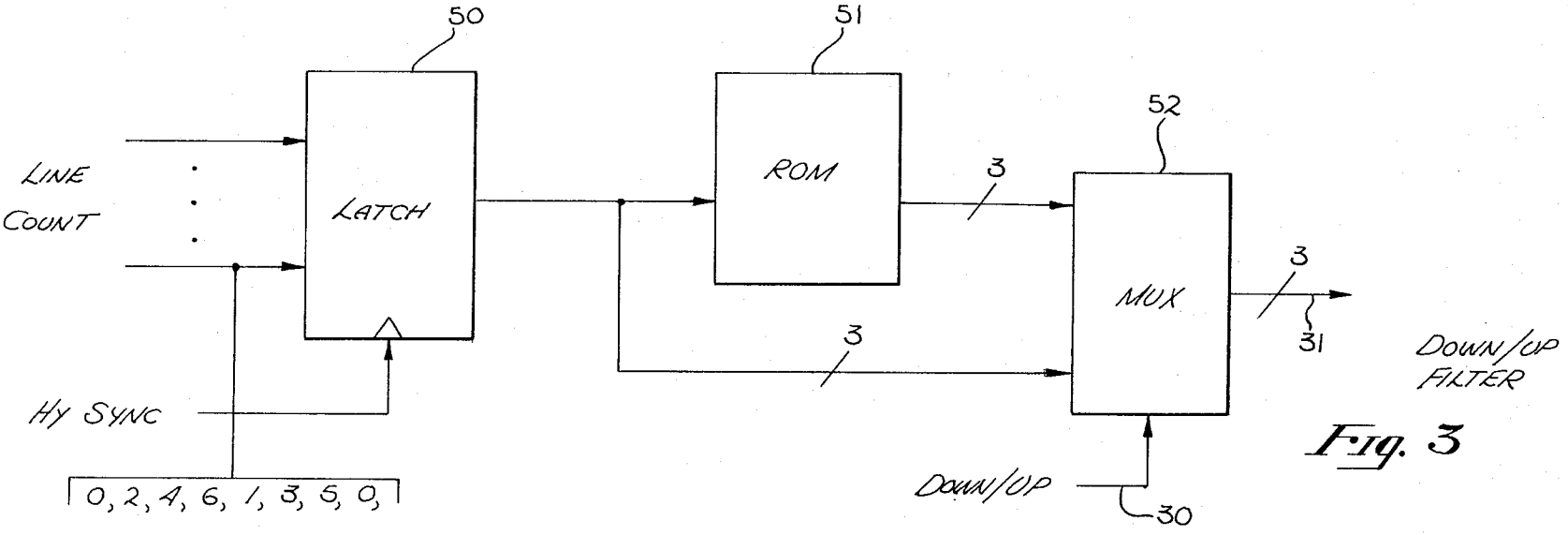
FIG. 3 is a block diagram of the down/up filter shown in FIG. 1.

Referring now to FIG. 3, the output of the line counter 22 of FIG. 1 is coupled to a latch 50. The count from the counter provides an even count of 0, 2, 4, 6 so that the even-numbered lines of one symbol or symbol-fragment are selected and then a count of 1, 3, 5 so that the odd lines of the next row of symbol or symbol-fragments are selected, and so on. On the subsequent frame, the even and odd count are reversed in order to provide the interlacing of the frames as is well-known. The count secured within the latch 50 for each line is coupled to a ROM 51 and also to a multiplexer 52. The ROM 51 is used to reverse the count. That is, if the count in the latch is zero (000) when this count accesses ROM 51, the output from the ROM 51 is 6 (110). Similarly, if the count in latch 50 is one (001) the output of the ROM 51 would be five (101). The signal on line 30 (down/up signal) is used to select either the output of the ROM 51 or the signal directly from the latch 50. The signals at the output of the multiplexer 52 are communicated by line 31 to form part of the address for the memory 25 as mentioned. (The four bit count used in the text-only mode is not shown in FIG. 3.)

The effect of the filter of FIG. 3 is to cause a particular symbol or symbol-fragment to be addressed, either with its first line first, or with its last line first. If for a moment we assume that the letter W is being accessed in the memory 25 and that the signal on line 30 is a one, then the normal count from the latch 50 will cause an ordinary W to appear on the screen. On the other hand, if the signal on line 30 is low, then the multiplexer 52 will select the output of the ROM 51 causing the letter W to appear upside down, that is, a letter resembling M.

Assume that the symbol of FIG. 7*a* is being displayed and both bits 11 and 12 are binary ones ("not active"). (This symbol can be within a single character block or formed from a plurality of symbol-fragments.) If the bit 11 is changed to a binary zero ("active"), the symbol is rotated counterclockwise 90 degrees as shown in FIG. 7*b*. Therefore, by the change of a single bit (or one bit for each fragment), the symbol is rotated. This is a substantial advantage over prior art techniques for rotating symbols which typically requires a remapping of substantial amounts of data in memory. (Note that to obtain the display of FIG. 7*b* when comprising a plurality of fragments requires repositioning (translation) of the fragments.

Referring again to FIG. 3, it should be noted that the line count changes only at the end of every line. On the other hand, the signal on line 30 may change with each character clock pulse. This allows the use of a latch 50 and a ROM 51 which are relatively slow since only the multiplexer 52 must react for each character block.

Figure 4:
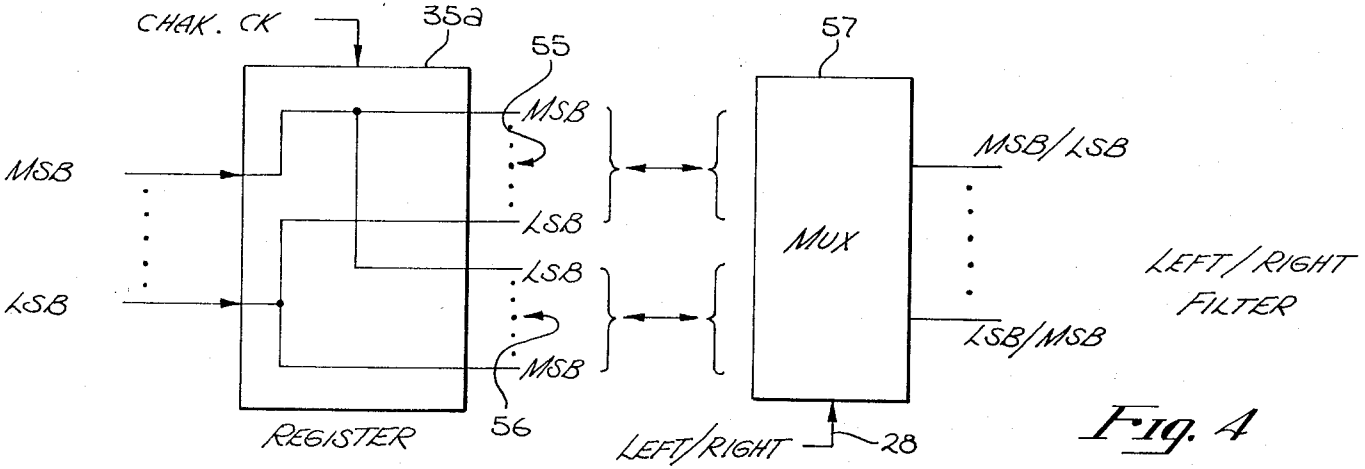
FIG. 4 is a block diagram of the left/right filter shown in FIG. 1.

Referring now to FIG. 4, a portion of the register 35 of FIG. 1 is illustrated as register 35*a*. The output of the memory 25 of FIG. 1 is shown coupled to the input of the register 35*a* with the bits identified from the most significant bit (MSB) to the least significant bit (LSB). The register 35 groups the incoming signals into two groups 55 and 56. In group 55, the most significant bit remains above the least significant bit, whereas in the group 56, the least significant bit is ordered above the most significant bit. Obviously, simple connections are used as illustrated to obtain these two groups.

The multiplexer 57 selects either the group 55 signals or the group 56 signals depending upon the state of left/right signal on line 28. If the signal on line 28 is a binary one, the multiplexer selects group 55, and at the output of the multiplexer 57 the most significant bit is above the least significant bit. On the other hand, if the signal on line 28 is a binary zero, the multiplexer 57 selects group 56 and at the output of the multiplexer the least significant bit is above the most significant bit. When the least significant bit is above the most significant bit, the binary information in each line of each symbol or symbol-fragment is reversed and is eventually shifted from the shift register 40 in a reversed order.

Referring again to FIG. 7*a*, for the symbol illustrated, bit 11 is a binary one. If bit 11 is changed to a binary zero and bit 12 remains a one, the symbol is rotated 90 degrees clockwise as illustrated in FIG. 7*c*. If both bits 11 and 12 are binary zeros, the symbol of FIG. 7*a* is rotated 180 degrees to the position shown in FIG. 7*d*.

Thus, by changing bits 11 and 12, a symbol can be rotated plus or minus 90 degrees, or 180 degrees.

This rotation is particularly helpful in rotating alphanumeric symbols. For instance, if the output of an AND gate is labeled "signal G" as shown in FIG. 8*a*, this AND gate can be readily rotated as shown in FIG. 8*b* and the letters forming "signal G" are be readily rotated also. It has been very difficult in the prior art to achieve this result especially for alphanumeric characters.

Figure 5:
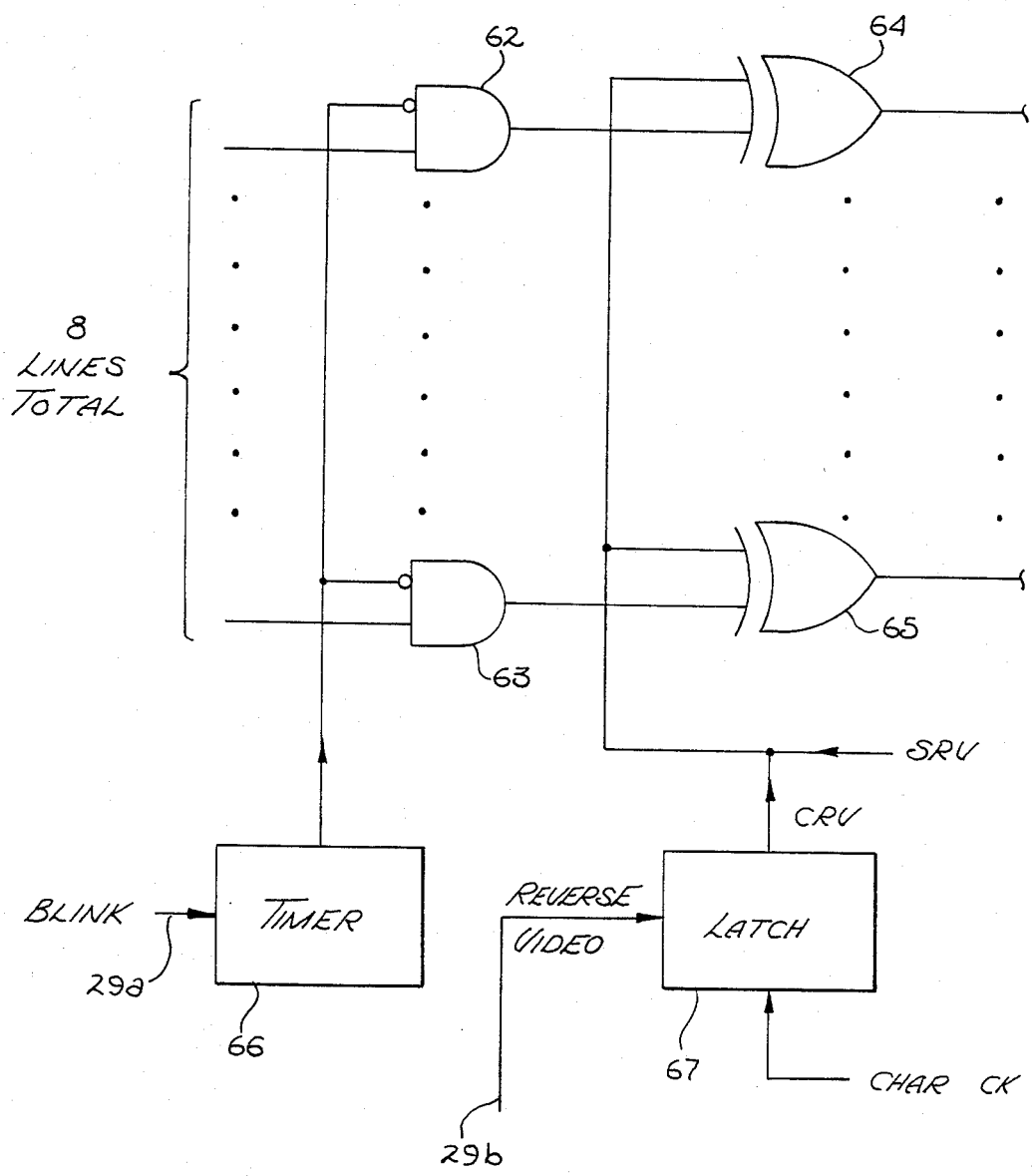
FIG. 5 is an electrical schematic of the video control filter shown in FIG. 1.

Referring now to FIG. 5, the video control filter 37 of FIG. 1 includes a plurality of AND gates such as AND gates 62 and 63 (one gate is used for each output of memory 25). The AND gates each include an inverting input terminal which are coupled to the timer 66. The other terminal of each of the AND gates receive one of the 8 bits of data (7 for the symbol and text mode). If bit 14 is a one, the output of the timer 66 remains low. The signals applied to the gates from the memory pass through the gates, unaffected. If the signal on line 29*a* is low, the output of the timer 66 is a square-wave with a period of approximately 1 second. This causes the outputs from the AND gates to be alternately unaffected and then all zeroes. This in turn causes the symbol or symbol-fragment associated with the signal on line 29*a* to blink. Note that a single symbol or part of a symbol (a single symbol-fragment) can be caused to blink with this arrangement.

The outputs from the gates 62 and 63 and like gates are coupled to one input terminal of gates 64 and 65 and like gates, respectively. The other input terminals of these exclusive-OR gates are coupled to the latch 67. The latch receives as an input signal the reverse video signal (line 29*b*). The latch is cleared by the character clock. If the output of the latch 67 is a zero, the signals from the gates 62 and 63 and like gates pass through the gates unaltered. On the other hand, if the output of the latch 67 is high, the signal at the output of these gates is reversed. This causes each of the symbols or symbol-fragments associated with the reverse video signal on line 28*b* to be reversed, that is, black will appear as white and white as black. The signal on line 29*b* simply sets the latch 67; the latch is cleared at the end of each character clock. The output of the latch is identified as the character reverse video (CRV) signal. The exclusive-Or gates also receive the SRV signal (screen reverse video). This signal causes the entire screen to be reversed.

There are another set of gates, again one for each of the bit lines in the left/right filter 36, which are used in the text-only mode for underlining each of the alphanumeric characters.

Thus, a display system has been described which allows a limited number of symbol-fragments to be arranged to form a plurality of symbols. The symbol-fragments can be rotated by simply changing two bits. This eliminates the prior art technique of moving symbol, pixel-by-pixel to obtain rotation. The resultant real time rotation is accomplished with only minor computer control and programming.

I claim:

1. In a raster scanned display, a system for providing symbols comprising:

memory means for storing a plurality of symbol-fragments, each of said symbol-fragments being represented in said memory means by a character block consisting of a predetermined number of lines and each of said lines including a predetermined number of bits;

a page buffer for storing data representative of said symbol-fragments required for an entire frame of said display;

a row buffer coupled between said page buffer and memory means;

first circuit means coupled to the input of said memory means for selectively providing said lines for said symbol-fragments in a first order or in a reversed order and;

second circuit means coupled to the output of said memory means for selectively providing said bits for said lines in a first order or in a reversed order after said lines are inputted to said memory means by said first circuit means;

whereby said symbol-fragments may be used to form symbols for said display with different orientations.

2. The system defined by claim 1 wherein said first circuit means comprises means for providing first address signals to said memory means to obtain said first order and second address signals to said memory means to obtain said reversed order.

3. The system defined by claim 2 wherein said second circuit means comprises:

first register means for receiving said predetermined number of bits and for arranging them in two groups, one of said groups for providing said first order and the other of said groups for providing said reversed order; and, multiplexing means coupled to said register means for selecting one of said first group and said second group.

4. The system defined by claim 3 including second register means for providing address signals for said memory means, said second register means coupled to said memory means.

5. The system defined by claim 4 wherein said second register means includes data for controlling said first circuit means and said multiplexing means, said second register being coupled to said first circuit means and said multiplexing means.

6. The system defined by claim 5 wherein said first and second registers each provide a delay approximately equal in time to the time required to display one of said lines.

7. The system defined by claim 1 or 6 including third circuit means for periodically converting said bits to the same binary state so as to cause symbols on said display to blink.

8. The system defined by claim 1 or 6 including fourth circuit means for converting said bits to their opposite binary state so as to provide a reversed video display.

9. In a raster scanned display, a system for displaying symbols comprising:

a memory for storing a plurality of symbol-fragments, each of said symbol-fragments being represented in said memory by a character block consisting of a predetermined number of lines and each of said lines comprising a predetermined number of bits;

a page buffer for storing data representative of said symbol-fragments required for an entire frame of said display;

a row buffer coupled between said page buffer and memory means;

addressing means coupled to said memory and said row buffer for selectively accessing said lines of said symbol-fragments in a first order or in a reversed order such that each symbol-fragment is read from said memory with either its first line first or its last line first;

circuit means coupled to said memory for receiving said bits for each of said lines of said symbol fragments and for selectively providing each of said lines of said symbol fragments with either its most significant bit first or with its least significant bit first;

whereby said symbol-fragments may be used to form symbols for said display with different orientations.

10. The system defined by claim 9 including a register for supplying addresses to said memory to control said addressing means and circuit means, said register being coupled to said memory, addressing means and circuit means.

11. The system defined by claim 10 wherein said register and circuit means each provide a delay equal in time to the time required to display one of said lines.

* * * * *